US007886757B2

(12) United States Patent
Hotes

(10) Patent No.: US 7,886,757 B2
(45) Date of Patent: Feb. 15, 2011

(54) TEMPORARY SHELTER WITH ADJUSTBLE DOOR SYSTEM

(76) Inventor: Doug Hotes, 13960-179th Ave. SE., Monroe, WA (US) 98272

( * ) Notice: Subject to any disclaimer, the term of this patent is extended or adjusted under 35 U.S.C. 154(b) by 149 days.

(21) Appl. No.: 12/154,161

(22) Filed: May 19, 2008

(65) Prior Publication Data

US 2008/0283107 A1 Nov. 20, 2008

Related U.S. Application Data

(60) Provisional application No. 60/930,915, filed on May 18, 2007.

(51) Int. Cl.
*E04H 15/36* (2006.01)

(52) U.S. Cl. ..... 135/122; 135/137; 135/153; 135/906; 160/89; 160/197; 52/86

(58) Field of Classification Search ..... 135/121–122, 135/124, 136–137, 906, 908; 160/87, 89, 160/97, 117, 195, 207, 210, 211, 213; 49/63, 49/409, 410; 52/86, 79.5, 63; 47/17
See application file for complete search history.

(56) References Cited

U.S. PATENT DOCUMENTS 659,981 A 10/1900 McCall
704,887 A * 7/1902 Low ..... 160/181
2,328,197 A * 8/1943 Cowin ..... 52/86
2,797,696 A 7/1957 Fritsche
2,806,477 A 9/1957 Fritsche
2,815,831 A * 12/1957 Hield et al. ..... 52/93.1
3,256,896 A 6/1966 Cummins
3,480,023 A 11/1969 McConnell
3,534,431 A * 10/1970 Uphoff ..... 16/82
3,760,861 A * 9/1973 Hammerstrom ..... 160/184
3,762,117 A * 10/1973 Horvath ..... 52/169.9
3,930,344 A 1/1976 Gahler ..... 52/2
4,222,401 A 9/1980 Allweil ..... 135/1
4,244,384 A 1/1981 Bean ..... 135/4
4,513,555 A * 4/1985 Johnson ..... 52/657
4,649,947 A 3/1987 Tury et al. ..... 135/97
4,802,500 A 2/1989 Davis et al. ..... 135/97
5,170,831 A * 12/1992 Bilt ..... 160/115
5,245,802 A 9/1993 Davis ..... 52/86
5,335,684 A * 8/1994 Hanninen ..... 135/124
5,566,736 A * 10/1996 Crider et al. ..... 160/121.1

(Continued)

*Primary Examiner*—Winnie Yip
(74) *Attorney, Agent, or Firm*—Dean A. Craine

(57) ABSTRACT

A portable temporary aircraft hanger that includes a light-weight frame covered with a durable, main outer cover. The frame includes a plurality of transverse frame members attached to a rigid base frame. Each frame member includes two opposite straight lower sections, two curved eave sections, two straight roof sections and a curved, central peak section. Adjacent frame members are interconnected by a plurality of purlins. Disposed over one end opening is a flexible end cover. Formed on one end panel of the shelter is wide rectangular door opening designed to allow wide equipment, such as a winged aircraft to easily enter and exit the shelter. In the first embodiment, the door opening is covered by two hinged door panels including a longitudinally aligned sliding door section. Disposed above the wide opening is an optional upper opening which is selectively closed and opened by a retractable door panel. In another embodiment, the lower door opening and upper opening are replaced by a single, large opening covered completely by a large retractable door.

3 Claims, 13 Drawing Sheets

U.S. PATENT DOCUMENTS 6,679,009 B2 1/2004 Hotes ..... 52/86
6,880,610 B1 * 4/2005 Bush ..... 160/202
7,600,348 B1 * 10/2009 Kostka ..... 52/63
2006/0107985 A1 * 5/2006 Sovine ..... 135/96

* cited by examiner

TEMPORARY SHELTER WITH ADJUSTBLE DOOR SYSTEM

This is a utility patent application which claims benefit of U.S. Provisional Application No. 60/930,915 filed on May 18, 2007

BACKGROUND OF THE INVENTION

1. Field of the Invention

The invention disclosed herein pertains to temporary shelters and more particularly to temporary shelters with adjustable wide doors.

2. Description of the Related Art

Companies and governmental agencies often need temporary shelters with wide doors that allow large equipment, such as aircraft, tanks, personal carriers and cranes, to easily enter and exit the shelter. Depending on the nature and size of the equipment that will be placed in the shelter and the amount of space available for the shelter, the door can be either a pivoting style mounted on hinges, a sliding-style mounted on wheels that ride on tracks, a folding-style that retracts or extends over a door opening or a curtain-style that unfolds or folds vertically over a door opening.

One drawback with doors used with large temporary shelters is that the doors must be made of smaller components that can be easily be transported in an aircraft and then easily assembled and disassembled at a remote location. Another drawback with temporary shelters with wide door openings is that special design features must be used to make it structurally stable and able to withstand strong winds when the door is opened or closed.

When a temporary shelter is used as an aircraft hanger, the door opening must be sufficient in width and height to accommodate the shape of the aircraft. Because the wing spans and shapes and heights of the vertical stabilizers vary with different aircraft, the size and shape of the door opening on the shelter may need to be adjusted. This is especially true with U.S. and foreign military because they use different types of aircraft.

Therefore, what is needed is a temporary shelter with a wide door system that uses doors made of components that can be easily transported in an aircraft, that is structurally stable to withstand high winds when the door is opened or closed, that allows the door opening to be adjusted for different size equipment to enter and exit the shelter.

SUMMARY OF THE INVENTION

It is an object of the present invention to provide a temporary shelter with a wide adjustable door system that when disassembled, can be stored in a compact configuration and easily transported.

It is another object of the present invention to provide such a shelter which when properly assembled, can be used in relatively high wind conditions.

It is another object of the present invention to provide such a shelter that uses two hinged lightweight door panels that easily swing open or close so that large equipment may enter and exit the shelter.

It is another object of the present invention to provide such a shelter with two hinged door panels each including a sliding door section that can be selectively retracted to create a smaller opening into the shelter.

It is a further object of the present invention to provide a shelter with an upper door opening covered by a retractable door panel thereby enabling a wide and tall piece of equipment, such as an aircraft, to enter and exit the shelter.

These and other objects are met by the temporary shelter disclosed herein that includes a lightweight, easy to assemble frame covered with a durable, main outer cover. The frame includes a plurality of upright, transverse frame members attached to a rigid base frame. During assembly, the base is set-up in a flat level area on the ground. Each frame member includes two opposite straight lower sections, two curved eave sections, two straight roof sections and a curved, central peak section. The frame members are vertically aligned and evenly spaced apart over the base frame. Adjacent frame members are interconnected by a plurality of purlins. After the frame has been assembled, a flexible main body cover is stretched and attached over the main frame body. A flexible end cover is stretched and attached to the shelter's end frame.

Formed on the end of the shelter opposite the flexible end cover is a wide lower rectangular opening designed to accommodate two hinged door panels. The two hinged door panels are pivotally attached to the shelter by two hinges located along one edge. Attached to each hinged door panel is a longitudinally aligned sliding door panel. Each sliding door panel moves longitudinally over the hinge door panel thereby enabling the door's overall length to be selectively adjusted. The sliding door panels are mounted on wheels that roll over a header which supports the door panels in a closed position over the wide door opening. In the preferred embodiment, the two hinged door panels and sliding door sections are made of lightweight tubing material and a durable fabric cover.

Disposed above the wide rectangular opening is an optional upper opening which is selectively closed and opened by a vertically retractable small door panel. The door panel is made of flexible material designed to fully cover the wide opening when extended. In the preferred embodiment, the lower edge of the flexible material is attached to a horizontal support bar that extends transversely in the door opening. The opposite ends of the support bar are connected to a rolling coupler that moves vertically inside tracks mounted on the perimeter edges of the upper opening. A header channel is attached to the bottom edge of the support bar which interconnects the two lower door panels when the two wide door panels are closed.

During use, the sliding door sections can be selectively retracted and extended to create different size openings into the shelter. Also, when the sliding door sections are retracted into their respective hinged door panel, the hinge door panels can be easily swung open to create a larger rectangular door opening. If a large, tall door opening is needed to allow aircraft or similar equipment to enter and exit the shelter, the two hinge doors and the retractable door panel can be easily opened.

In another embodiment, the wide lower rectangular opening and the upper opening are replaced by a single tall rectangular opening. A vertically expanding and retaining, curtain-style door is used in place of the two hinged door panels and the retractable small door panel. When using a single, tall rectangular opening and a single curtain-style door, the height of the door may be easily adjusted to accommodate different style aircrafts.

DESCRIPTION OF THE PREFERRED EMBODIMENT(S)

Figure 1:
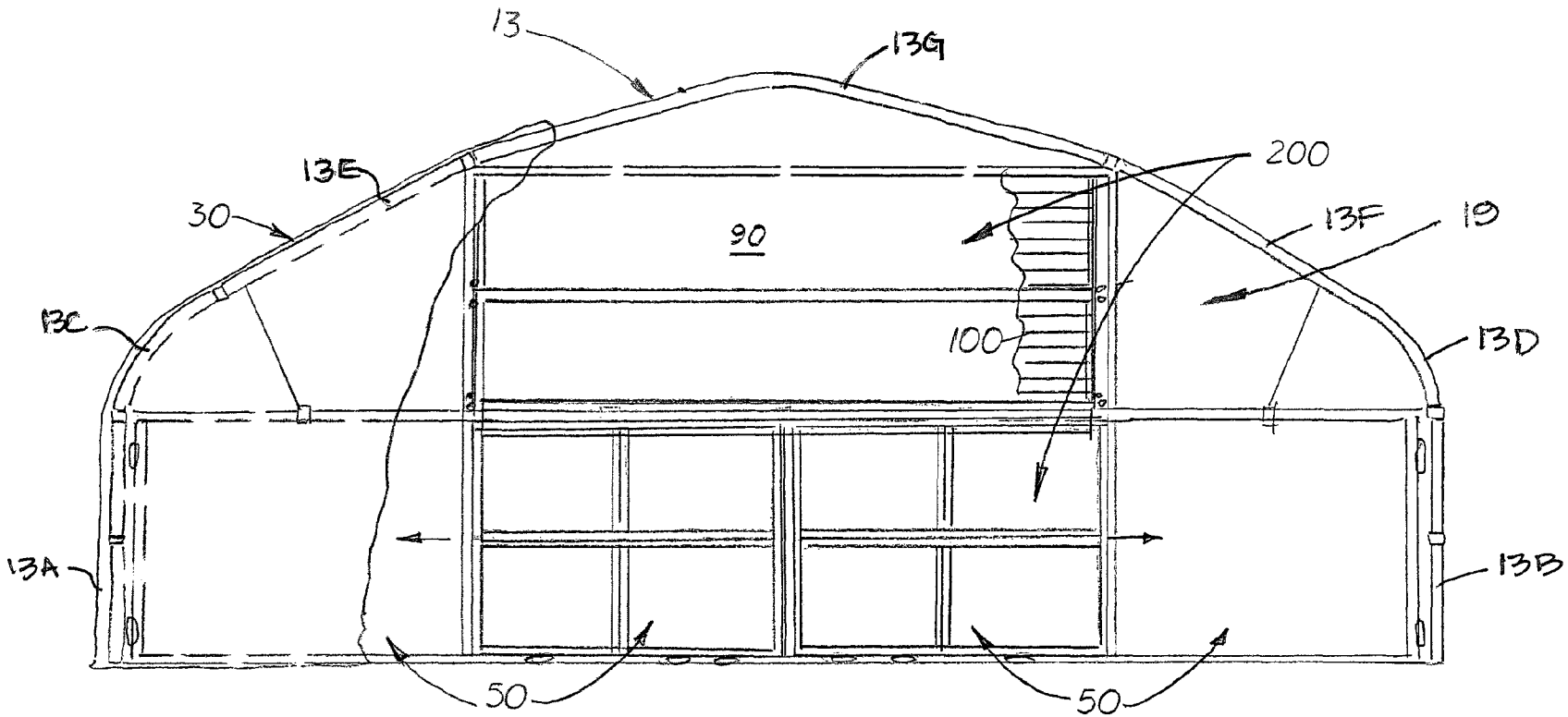
FIG. 1 is a front elevational view of the temporary shelter with a wide door opening formed therein.
Figure 2:
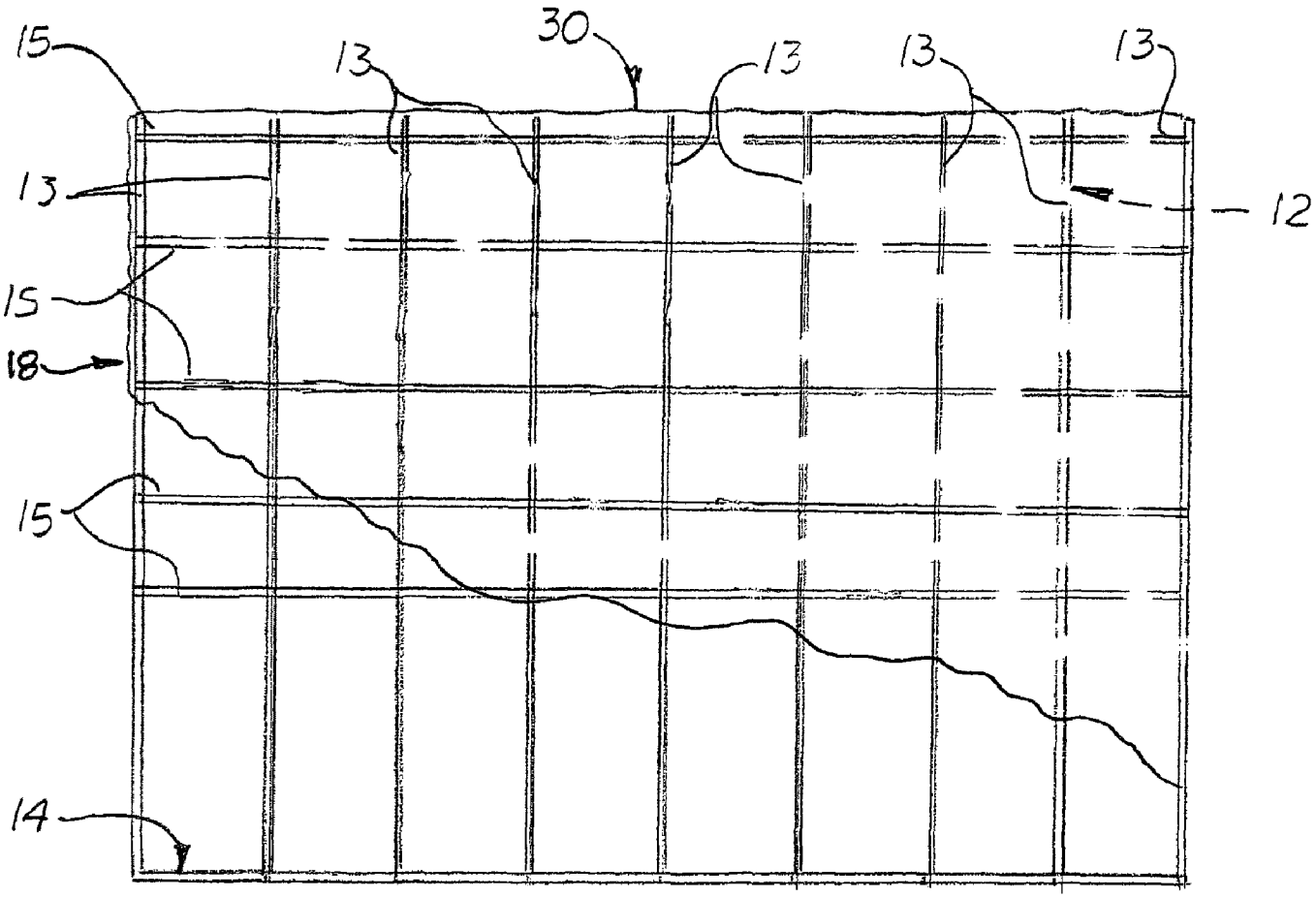
FIG. 2 is a side elevational view of the shelter shown in FIG. 1.
Figure 3:
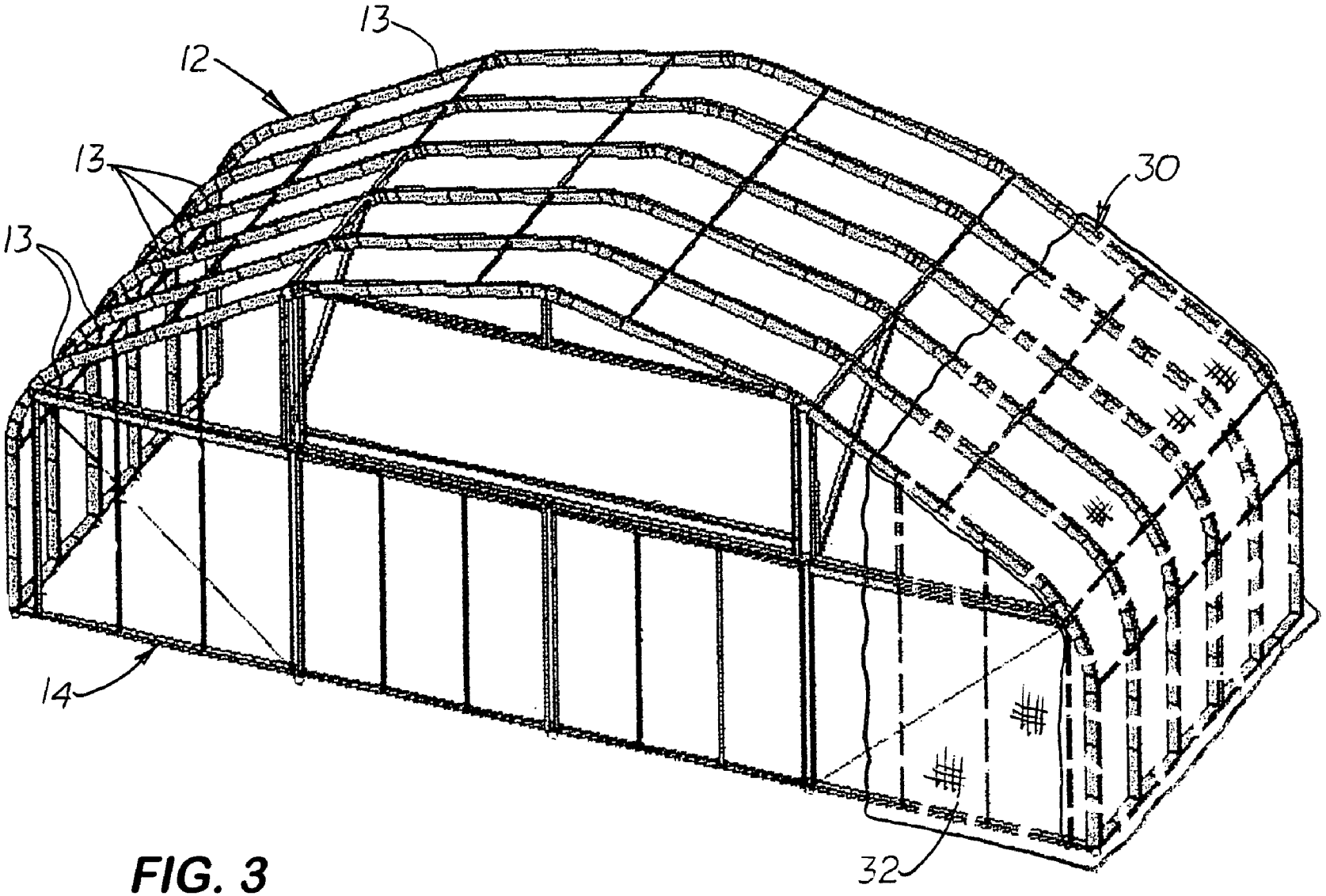
FIG. 3 is a rear perspective view of the shelter shown in FIGS. 1 and 2.

Referring to FIGS. 1-16, there is shown a temporary shelter 10 with a wide rectangular lower opening 50 formed therein. The shelter 10 includes a lightweight frame 12 covered with a durable, main outer cover 30. The frame 12 includes a plurality of transverse arching frame members 13 attached to a rigid three sided base frame 14. Each frame member 13 includes two opposite straight lower sections 13A, 13B, two curved eave sections 13C, 13D, two straight roof sections 13E, 13F and a curved, central peak section 13G. Adjacent frame members 13 are interconnected by a plurality of purlins 15. Formed on the shelter 10 is a closed wall 18 made of a plurality of vertical posts covered by a flexible end cover 32.

The shelter 10 includes a closed end wall 18 and a door wall 19 formed opposite of the closed wall 18. Formed on the door wall 19 is a wide rectangular-shaped lower opening 50. In the first embodiment, the lower opening 50 extends substantially the entire width of the shelter 10.

Figure 4:
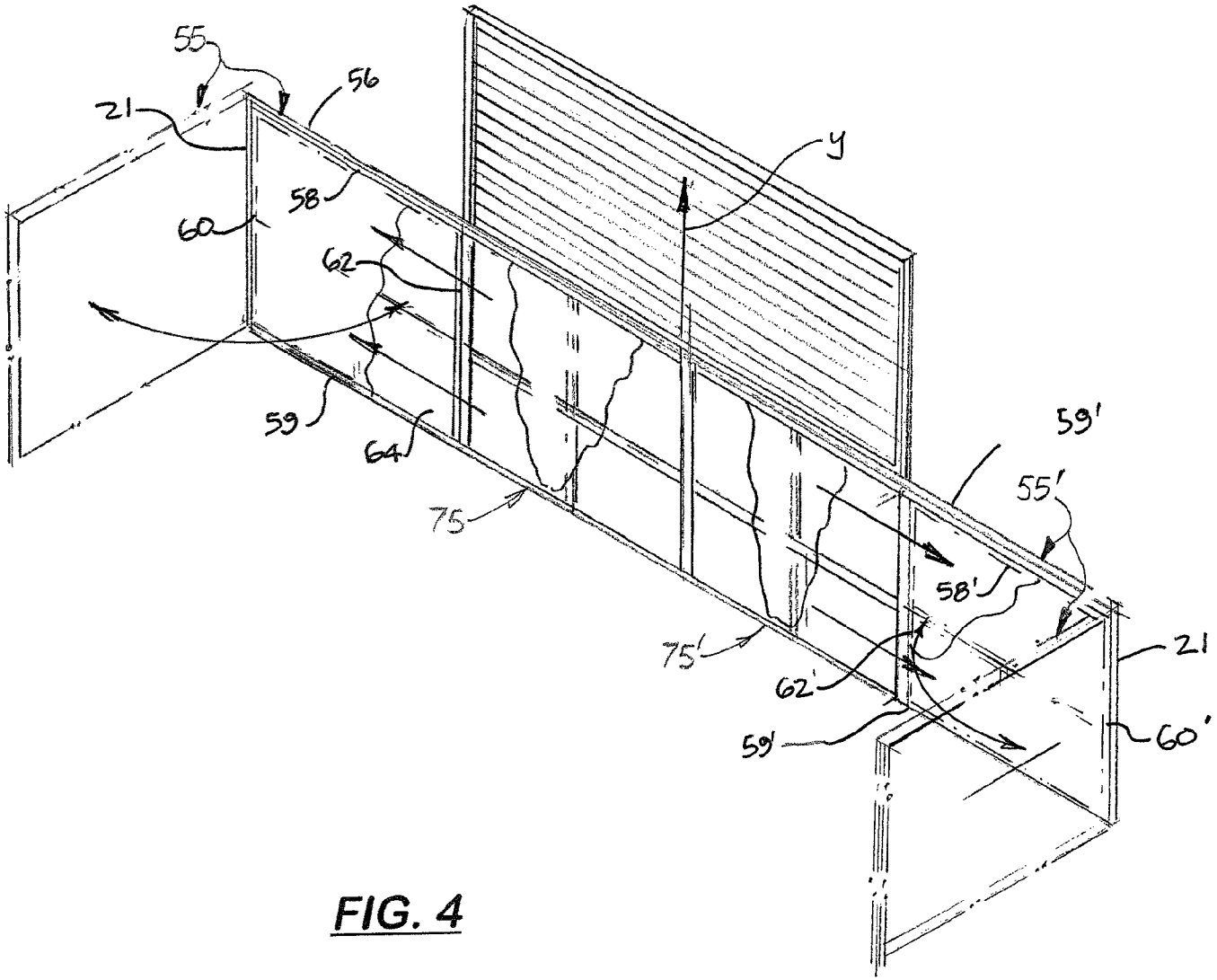
FIG. 4 is a perspective view of the end wall showing a wide lower opening formed therein with two hinged door panels each including a sliding door section, and an upper opening with a retractable flexible door panel located therein.
Figure 5:
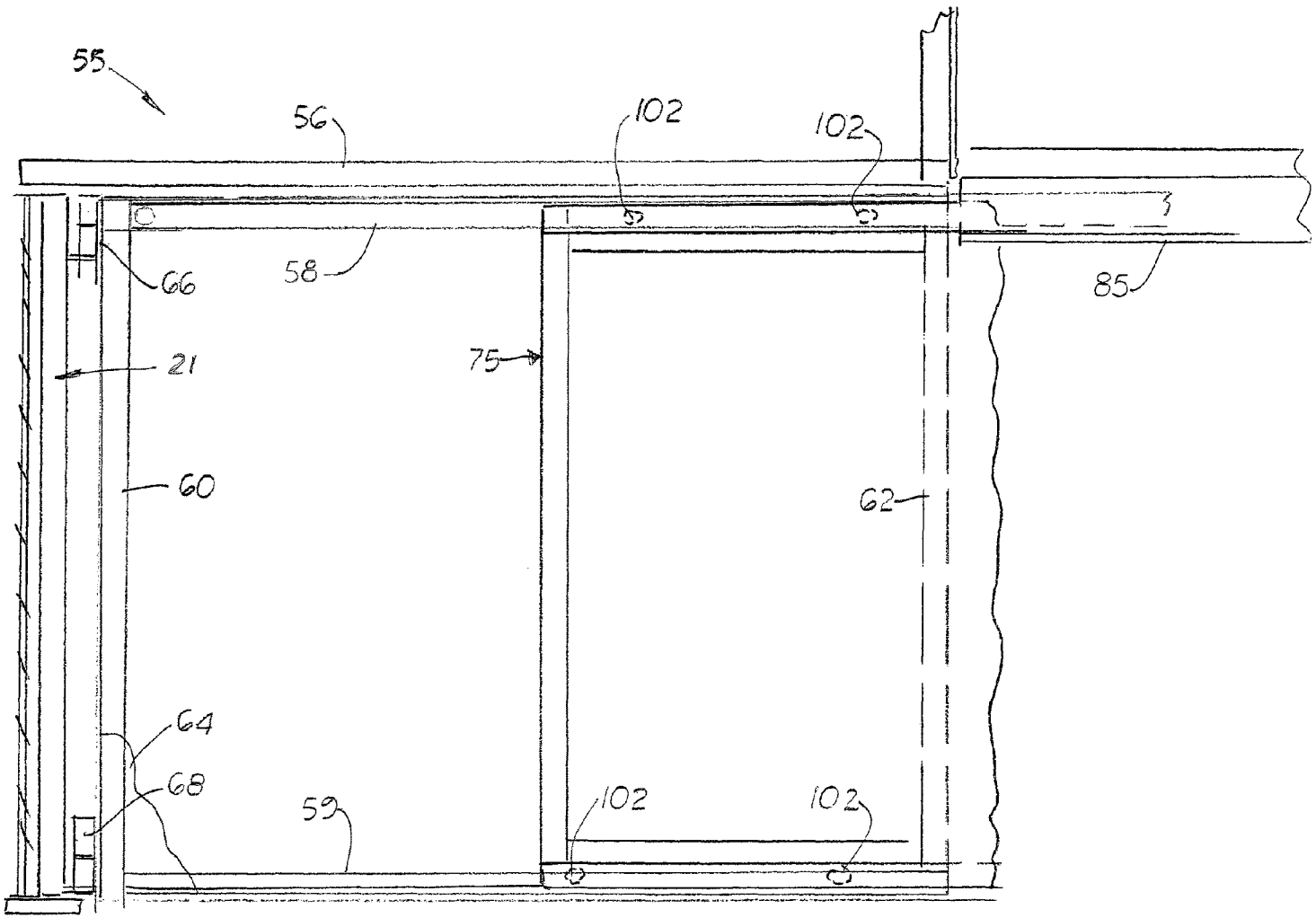
FIG. 5 is a partial front elevational view of a hinged door panel with a sliding door section attached thereto.

Located inside the lower opening 50 are two square or rectangular-shaped pivoting door panels 55, 55'. As shown in FIGS. 4 and 5, each door panel 55 55'includes an outer frame comprising two horizontal rails, 58, 59 and two vertical rails 60, 62. Each door panel 55, 55' is covered by a flexible cover 64. Two hinges 66, 68 are used to attach one vertical rail 60 to a corner post 21 on the frame 12. During use, each door panel 55, 55' is able to independently pivot outward approximately 90 degrees, as shown in FIG. 4.

Each door panel 55, 55' has a length of approximately ¼ to ⅓ the width of the shelter 10. Each door panel 55, 55' includes a sliding door section 75, 75', respectively, which is sufficient in length and width to close approximately one-half of the wide opening 50 when the door panel 55 or 55' is closed and the sliding door section 75 or 75', respectively, is extended. As shown in FIGS. 4 and 5, each sliding door section 75, 75' is longitudinally aligned on the hinge door panel 55, 55', respectively, via a plurality of wheels 102 that roll over horizontal supports, 56, 56' located on the door wall 19 and above the top rails 56, 56' on the door panels 55, 55'. When the sliding doors 75, 75' are extended from the two hinged door panels 55, 55', the upper wheels 110 engage a fixed channel-shaped header 85 provided on the end door wall 19 or that extends from the top edge of one of the hinged door panels 55, 55' which hold the two sliding door sections 75, 75' in a closed position. Optional locks (not shown) are provided to hold each sliding door section 75, 75' in a fixed longitudinally aligned position on each hinged door panel 55, 55', respectively.

In the preferred embodiment, the two hinged door panels 55, 55' and sliding door panels 75, 75' are made of lightweight tubing material and a durable fabric cover.

In another embodiment of the invention, the door wall 21 also includes an small upper opening 90 which when combined with the wide lower opening 50 forms an inverted T-shaped opening 200. An inverted T-shaped opening generally denoted as 200 is desired when the shelter 10 is used with a winged aircraft (not shown) with a vertical stabilizer. During use, the lower door opening 50 is able to receive the two wings and the fuselage of the winged aircraft and an upper opening 90 is able to receive the vertical stabilizer on the winged aircraft.

Figure 6:
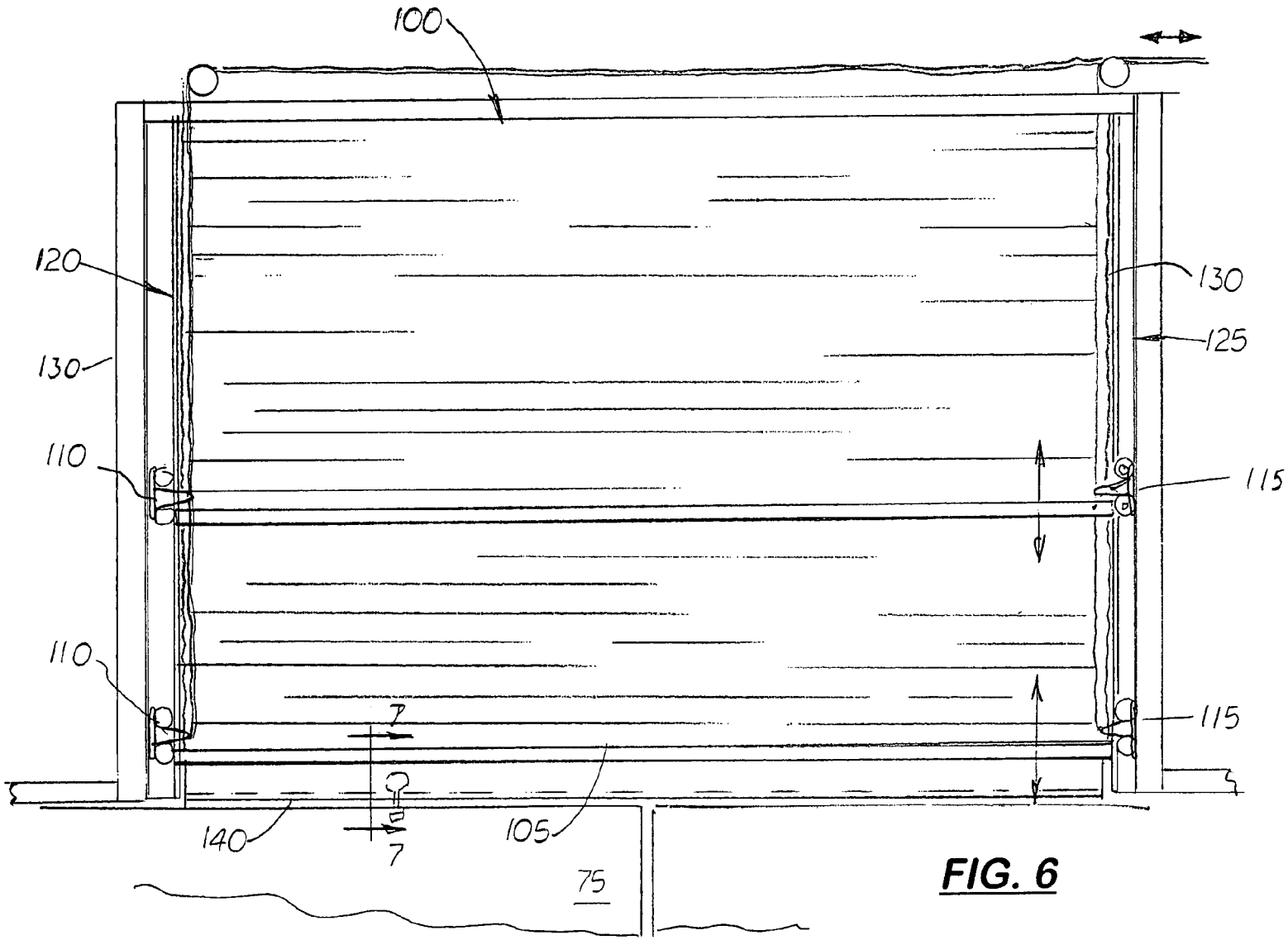
FIG. 6 is a partial front elevational view of the retractable door panel in the upper opening and showing the two sliding door sections in a closed position retained by a channel attached to the lower support bar.
Figure 7:
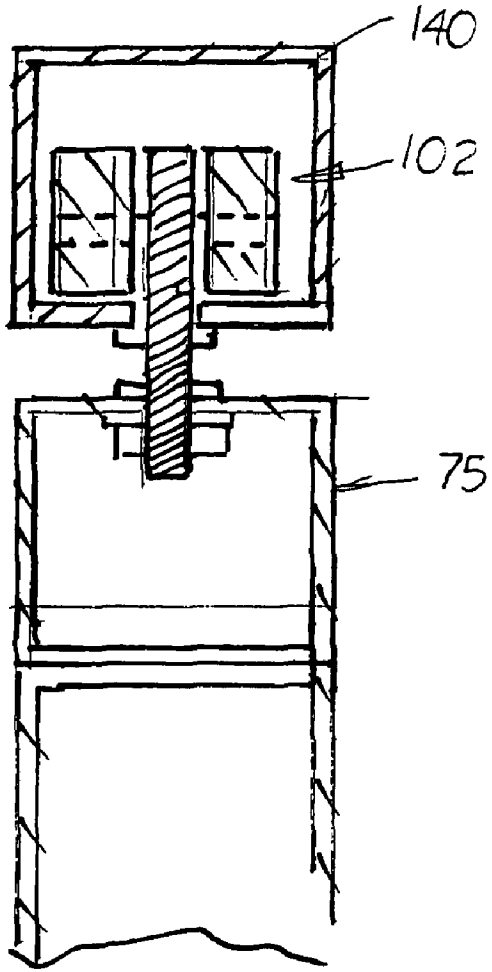
FIG. 7 is a sectional side elevational view of a sliding door section hung from the channel attached to the lower support bar as shown along line 7-7 in FIG. 6.

Disposed in the upper opening 90 is a vertically retractable door panel 100. In the preferred embodiment, the retractable door panel 100 is made of flexible material which can be selectively opened to different amounts to accommodate different aircraft. As shown in FIG. 6, in the preferred embodiment, the retractable door panel 100 includes a lower horizontal support bar 105 that extends longitudinally across the door opening 90. The opposite ends of the support bar 105 are connected to roller couplers 110, 115 that move vertically inside two vertical tracks 120,125 mounted on the vertical edges of the door opening 90. Cables 130 are attached to the couplers 110, 115, which pull the couplers 110, 115 along the tracks 120, 125 to retract the door panel 100.

When an upper door opening 90 is provided, a head channel 140 is attached to the lower support bar 105 which interconnects the two lower door sections 75, 75' when the hinged door panels 55, 55' are closed.

During use, the sliding door sections 75, 75' can be selectively retracted and extended to create different size openings into the shelter 10. Also, when the sliding doors sections 75, 75' are retracted into their respective hinged door panels 55, 55', respectively, the hinge door panels 55, 55' can be easily swung open to create a wide tall inverted T-shaped opening 200. When an upper door opening 90 is provided, the two sliding door sections 75, 75' must be retracted in the hinged door panels 55, 55', respectively, so that the retractable door panel 100 may be retracted. Once all of the door panels 55, 55', 100 are opened or retracted, a winged aircraft may enter or exit the shelter 10.

FIGS. 8-16 shows another embodiment of the shelter 10' wherein the lower rectangular opening 200 and the upper opening are replaced by a single, tall rectangular opening. The shelter is similar to the shelter shown in FIGS. 1-7. The shelter 10' includes a three sided lower base frame 14 with a plurality of arching frame members 13' and purlins 15' coupled together. Extending over the top, sides and end walls of the shelter are flexible outer covers 30', 32'.

Figure 8:
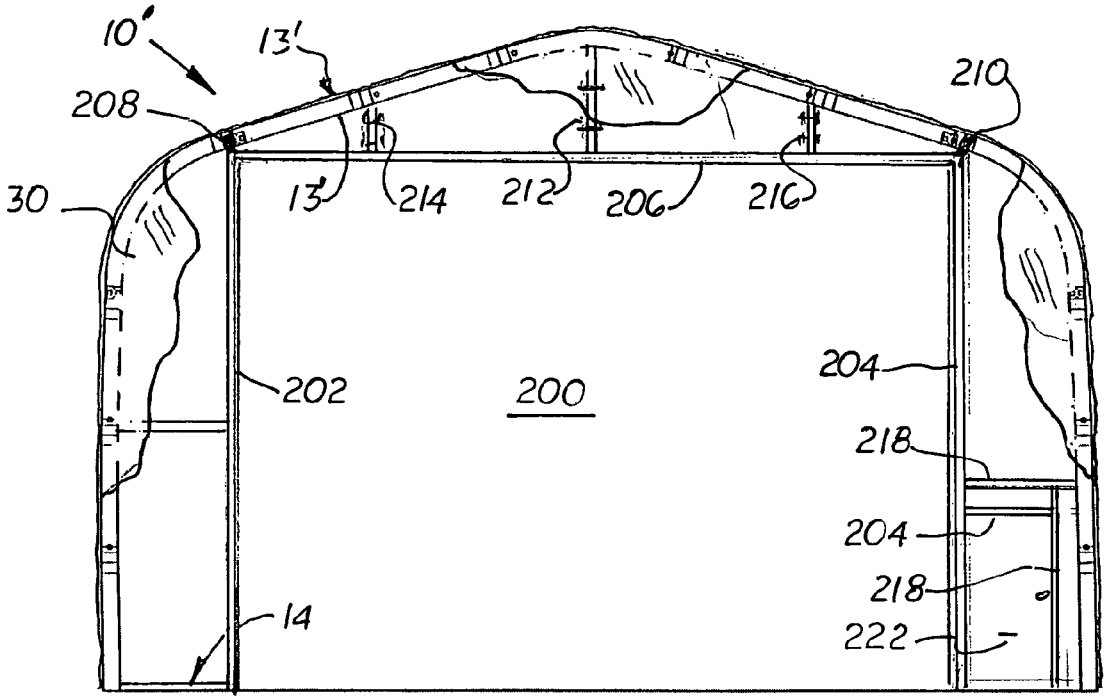
FIG. 8 is an elevational view of another embodiment of the shelter with a large curtain-style door opening formed on one end.

As shown in FIG. 8, the end where the opening 200 is formed includes two vertically aligned side members 202, 204 and a header beam 206. The header beam 206 is supported at its opposite ends by two straps 208, 210 that connect to the opposite eave members on the end frame member 13'. Extended upward from the header beam 200 to the frame member 13' is a length adjustable, vertical center support 212 and two adjustable, vertical mid axis supports 214, 216. Extending laterally from the vertical side member 218 is a door support 204. Located below the door support 218 is a door header 220. During assembly, a pivoting door 224 is attached to the vertical door frame member 222.

Figure 9:
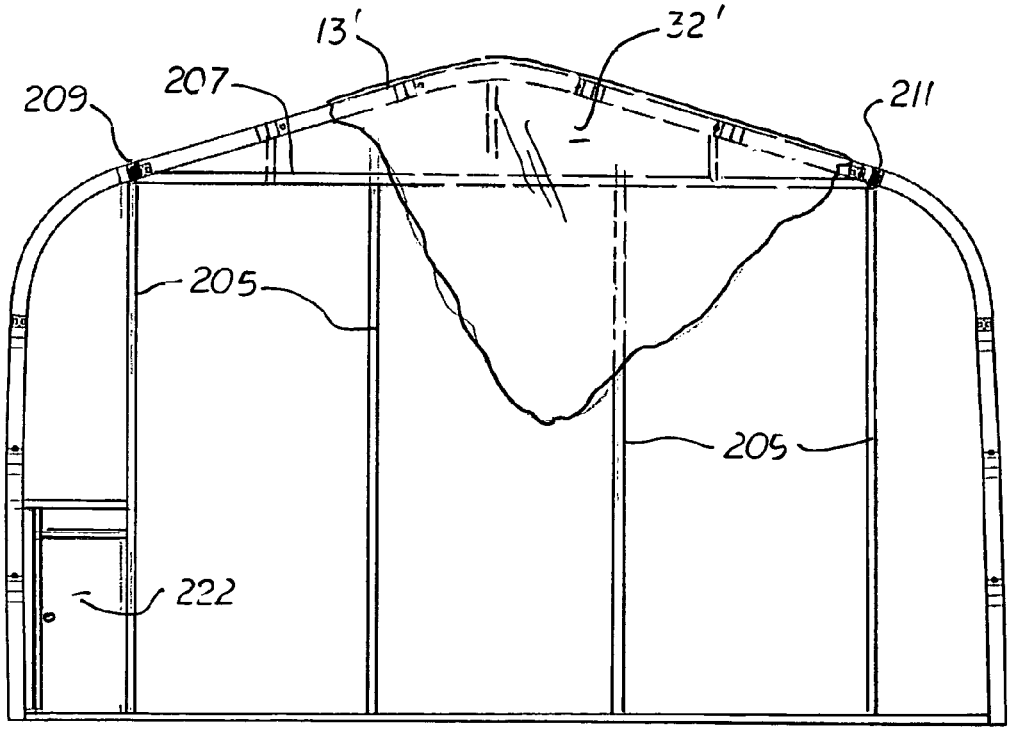
FIG. 9 is an elevational view of the embodiment of the shelter shown in FIG. 8 showing the opposite closed end wall.
Figure 10:
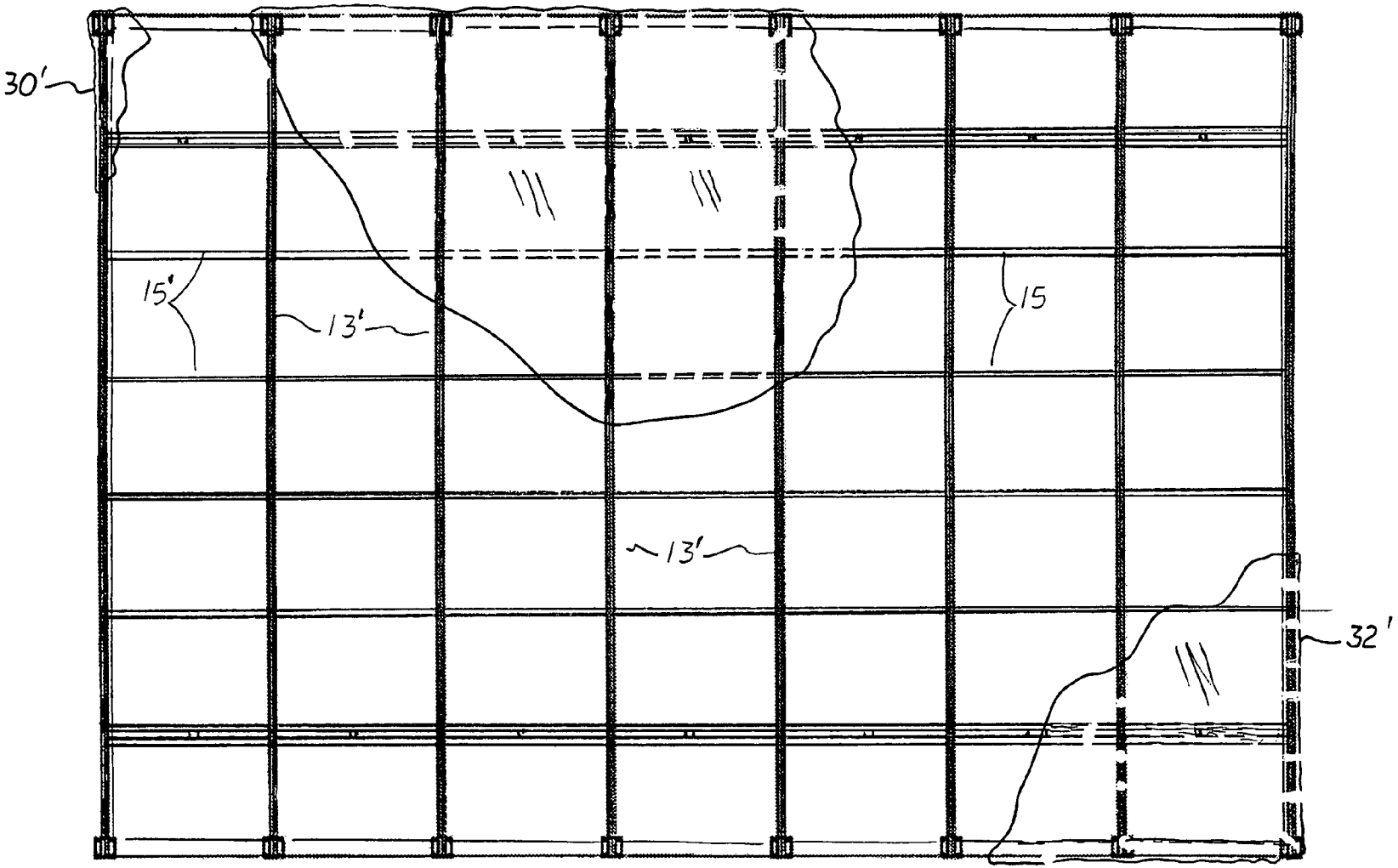
FIG. 10 is a top plan view of the frame assembly of the shelter shown in FIGS. 8 and 9.

As shown in FIG. 9, the opposite end wall is made of four vertical members 205 and an upper horizontal member 207. Two straps 209, 211 connect the upper ends of the two outside vertical members 205 to the end frame members 13'.

Figure 11:
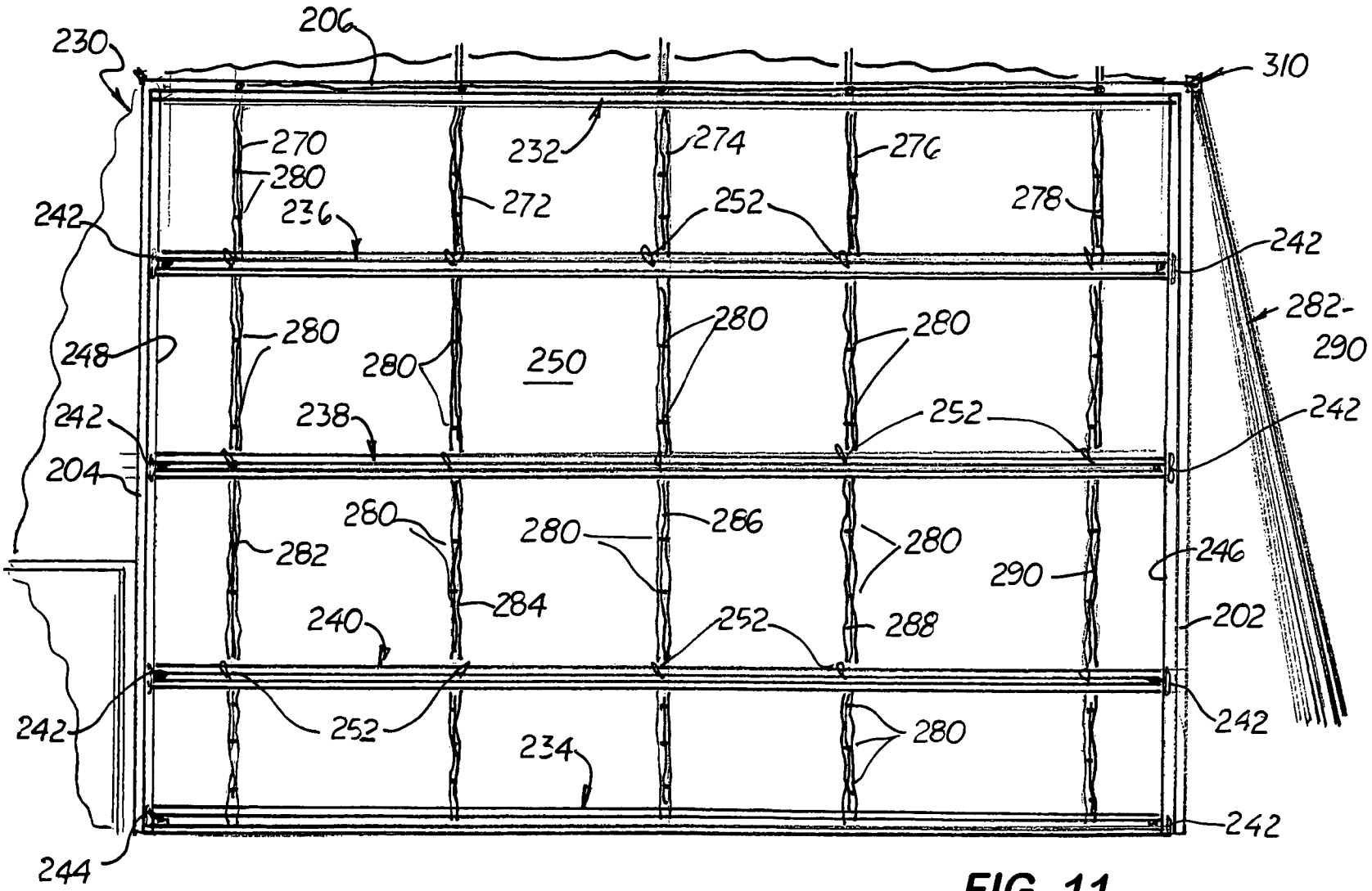
FIG. 11 is a rear elevational view of the curtain-style door in a closed configuration.
Figure 12:
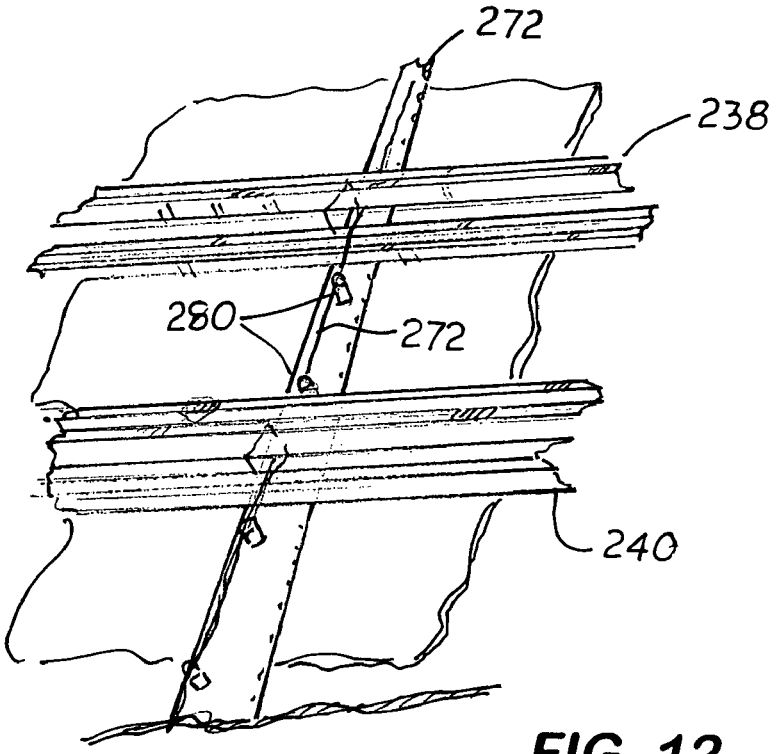
FIG. 12 is a perspective view of a section of the curtain-style door showing the relatively locations of two door beams, the flexible strip, four D-straps and a pull cable.
Figure 13:
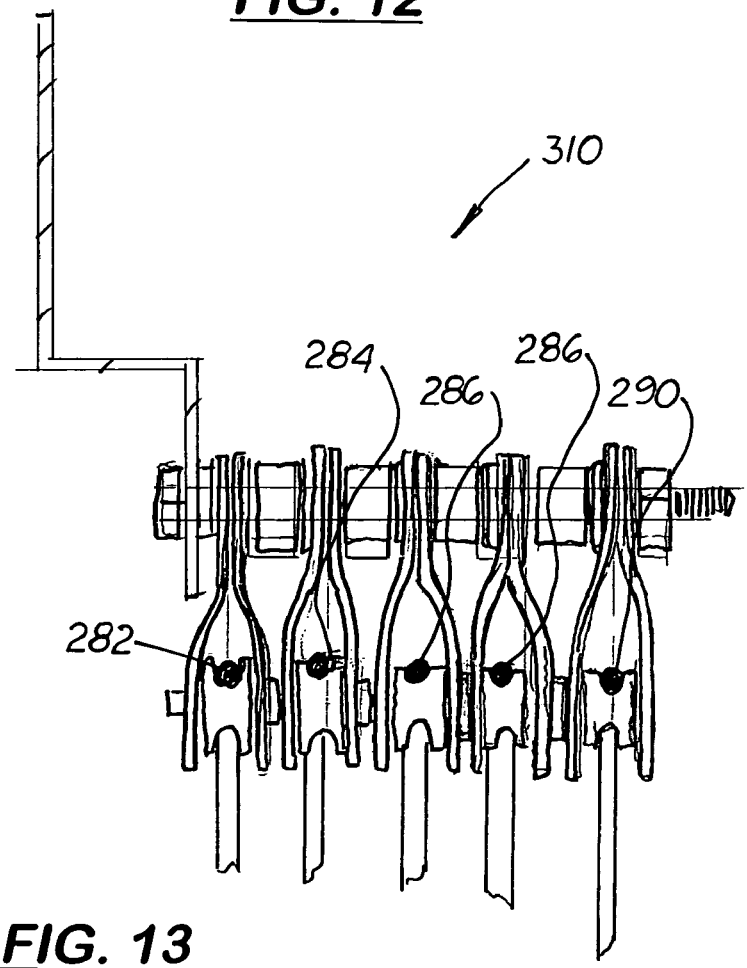
FIG. 13 is a side elevational view of a header multiple pulley assembly.
Figure 14:
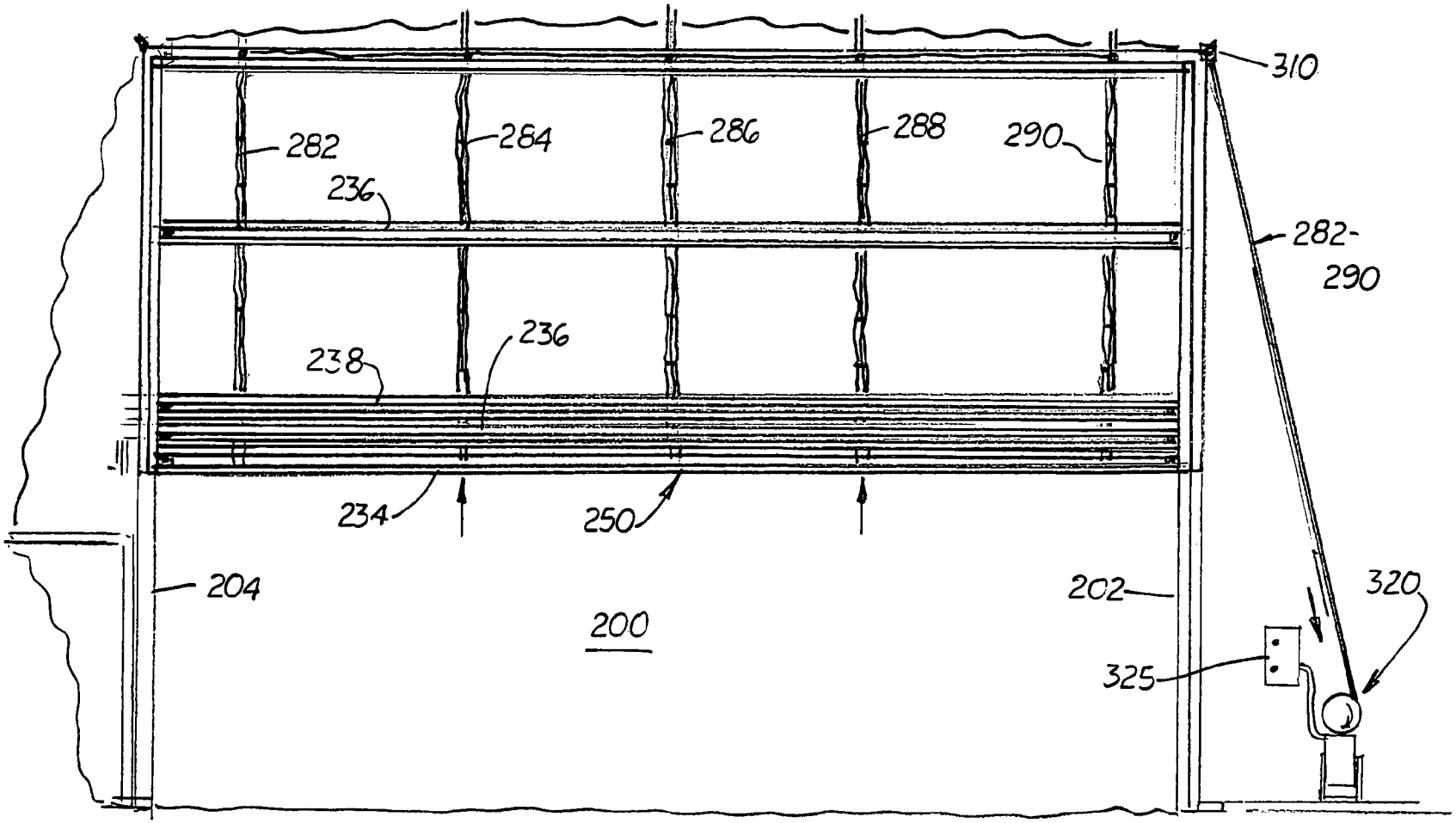
FIG. 14 is a rear elevational view of the curtain-style door partially lifted.

Disposed inside the tall, rectangular opening 200 is a single retractable curtain-style door 230, shown more clearly in FIG. 11. The curtain-style door 230 is made of an upper and lower horizontal beams 232, 234 and three intermediate horizontal beams 236, 238, 240. Attached to the end of each beam 240 is a roller 242, 244 that rides inside vertically aligned tracks 246, 248 formed along the inside surface of the two vertical side members 202, 204, respectively.

Figure 15:
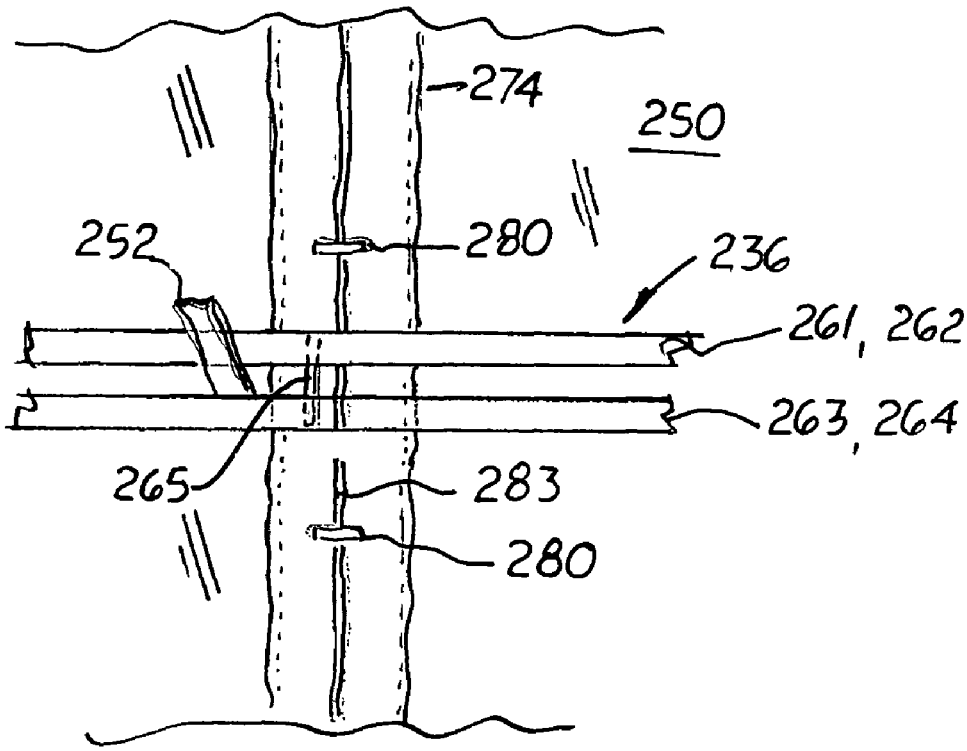
FIG. 15 is a partial rear elevational view of the curtain-style door showing the strip extending under a door beam, the relative locations of two D-straps and a hook and loop strap used to attach the cover to the door beam.
Figure 16:
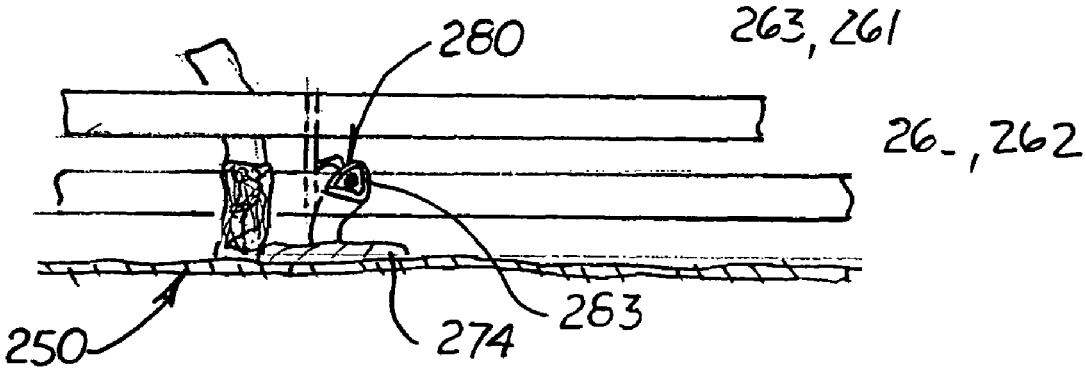
FIG. 16 is a side elevational view of the door beam, a D-strap and the hook and loop strap.

Covering the door opening 200 and the outside surfaces of the horizontal beams 232-240 is a flexible door cover 250. Sewn or adhesively attached to the inside surface of the cover 250 is a plurality of hook and loop straps 252. The hook and loop straps 252 are located along the inside surface of the cover so they extend over and attached to one of the horizontal beams 232-240 located behind the cover 250. As shown in FIGS. 15 and 16, each horizontal beam 232-240 is made of four tubular members 261-263 connected together by a center rib 265.

Also sewn or adhesively attached to the inside surface of the door cover 250 are five vertically aligned strips 270, 272, 274, 276, 278. Each strip 270, 278 extend from the top end to the bottom edge of the door cover 250. Attached to the inside surface are a plurality of inward extending short D-ring flexible straps 280. During assembly, a pull cable 282-284, 286, 288, 290 extends downward from a pulley 292, 294, 296, 298, 300, respectively, located on the header beam 206 located directly above each strip 270-278. Cables 282-290 extend downward over the strips 270-278 extend through the D-ring straps 280, across the intermediate beams 236-240 and securely attach at one to the lower horizontal beam 234. The cables extend laterally adjacent to the upper header beam 232 through pulleys and collected together via a multiple pulley block assembly 310 located at the upper corner of the door opening. In the embodiment shown in FIGS. 8-5, the door measures approximately 30 feet in width and 18 feet in height. Five pull cables 282-290 that connect to the lower horizontal beam 240 used to lower and raise a door. The cables 282-290 extend downward from the pulley assembly 310 and connect to an electric wench 320 located near the door opening 200. A switch box 325 is connected to the electric wench 320 that allows the door 250 to be selectively opened or closed.

In compliance with the statute, the invention described herein has been described in language more or less specific as to structural features. It should be understood however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A temporary shelter with an adjustable wide door opening, comprising:

a. a lightweight frame that includes a plurality of transverse frame members attached to a rigid base frame, each said frame member including two opposite straight lower sections, two opposite eave sections, two straight roof sections and a central peak section, said frame also include a plurality of purlins that extend between adjacent said frame members to hold them apart and vertically aligned them over said base frame, said frame includes two end walls;

b. a main outer cover disposed over said frame members;

c. two end covers disposed over said end walls;

d. a wide, lower rectangular door opening formed on at least one said end wall, e. an upper door opening formed above said lower rectangular door opening to form a large inverted T-shaped opening on said end wall when said lower rectangular door opening and said upper door opening are simultaneously opened to enable wide and tall objects to enter and exit said shelter;

f. a vertically retractable door disposed over said upper door opening, said vertically retractable door includes a lower edge;

g. a swing door panel disposed inside said lower rectangular opening, each said swing door panel being pivotally at one end to the opposite corners of said end wall, each said door panel includes a sliding door section that selectively moves longitudinally over said door panel to selectively adjust the length of said door panel, each said sliding door section able to engage said lower edge on said vertical retractable door when said vertical retractable door is extended downward over said upper door opening to close said inverted T-shaped opening.

2. The temporary shelter, as recited in claim 1, wherein said vertically retractable door panel is made of flexible material.

3. The temporary shelter, as recited in claim 1 wherein said retractable door is a roll-up door.

* * * * *